United States Patent [19]

Fleischmann

[11] Patent Number: 4,885,017

[45] Date of Patent: Dec. 5, 1989

[54] HEAT TRANSFER UNIT

[76] Inventor: Dale Fleischmann, P.O. Box 763, Wausau, Wis. 54401

[21] Appl. No.: 92,562

[22] Filed: Sep. 3, 1987

[51] Int. Cl.[4] ..... F25B 9/00

[52] U.S. Cl. ..... 62/6; 60/526

[58] Field of Search ..... 62/6; 237/2 B, 324.1; 60/517, 526, 516

[56] References Cited

U.S. PATENT DOCUMENTS 4,455,826 6/1984 Knoos ..... 62/6 X 4,462,212 7/1984 Knoos ..... 62/6 X 4,498,295 2/1985 Knoos ..... 62/6 X

*Primary Examiner*—Henry A. Bennet

*Attorney, Agent, or Firm*—Fuller, Puerner & Hohenfeldt

[57] ABSTRACT

A device by which one can extract low grade thermal energy and transfer that thermal energy from one medium to another utilizing a Stirling engine compressor means, motor means, heat exchanger means and regeneration chamber. The flow of thermal energy between the two heat exchanger means utilized is reversible by the simple change in direction of rotation of the motor means.

10 Claims, 2 Drawing Sheets

HEAT TRANSFER UNIT

BACKGROUND OF THE INVENTION

This invention pertains to apparatus for transferring heat energy from one medium to another and more particularly to apparatus for providing the reversible heating/cooling of an interior space.

The present invention is a device by which one can extract low grade thermal energy and transfer that thermal energy to another medium. Traditionally, this is now being done with a single piston heat pump. The present invention can be reversed but without the complicating reversing valve as is standard with a heat pump.

SUMMARY OF THE INVENTION

In accordance with the present invention, a compressor is provided with a cylinder or cylinders that contains two pistons driven by a reversible motor means through a rhombic drive means. The configuration of the cylinder and its two pistons is that of a Stirling engine. The Stirling engine, which has been well-known for over 100 years, possesses a reversible heat-to-mechanical energy conversion process which allows it to be utilized as a refrigerator or heat pump. The cylinder of the Stirling engine has two ports each connected to a heat exchanger means with a regeneration chamber connecting the two heat exchanger means to each other. The regeneration chamber has an interior mass composed of a material that possesses high thermal conductivity such as copper filings, which filings are used to absorb heat and cold extremes flowing between the two heat exchanger means. The heat exchanger means can be of a variety of configurations employing different heat transfer mediums such as water, oil, glycol, air, etc. The present invention is a closed loop system that can employ a variety of gases such as helium, argon, freon and air to be used in the compressor cylinder.

Since Boyle's Law determines that the compression of a gas increases the temperature of that gas and the decompression of a gas results in a decrease in temperature of that gas, the movement of the two pistons in the cylinder as defined by the rhombic drive means results in a large variation in temperatures between the two heat exchanger means connected to the cylinder. One of the heat exchanger means connected to the cylinder will have a cooler ambient temperature and the other heat exchanger means connected to the cylinder will have a warmer ambient temperature. It is a feature of the present invention that the heating/cooling procedure is reversible by the simple means of reversing the direction of the motor means driving the pistons in the cylinder without the need of a reversing valve.

The heat transfer unit described in the present invention can be employed in any place that a typical compressor means is used in a heating or cooling system. It can be used in a wide range of industrial, commercial or residential heating, cooling, heat reclaiming or storage systems. Other objects and advantages of the invention will become apparent from the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
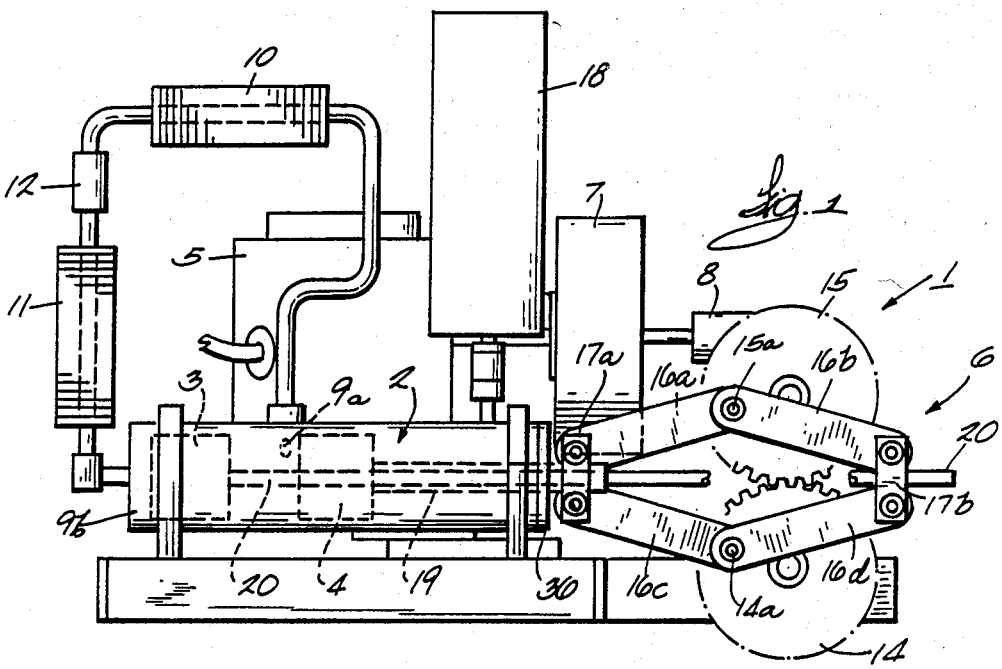
FIG. 1 is a side view of the preferred embodiment of the invention.
Figure 2:
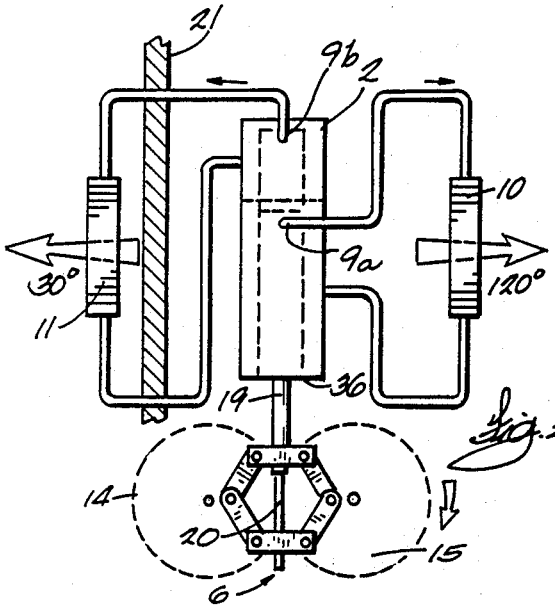
FIG. 2 is a perspective view of the preferred embodiment of the invention in the Heating Mode.
Figure 3:
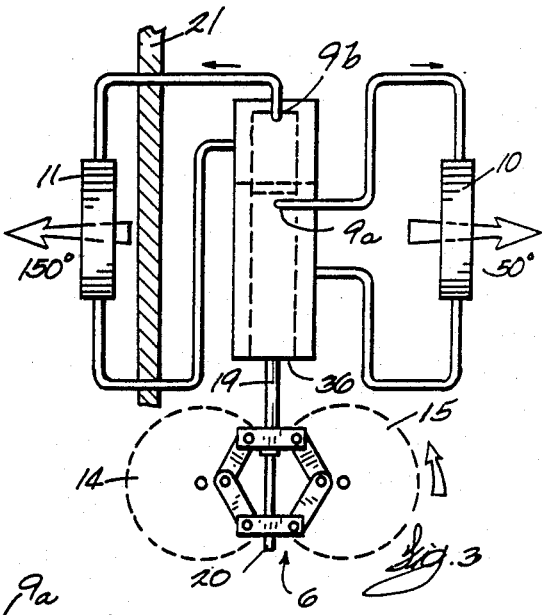
FIG. 3 is a perspective view of the preferred embodiment of the invention in the Cooling Mode.

Referring to FIGS. 1–3, an apparatus 1 is illustrated that includes one embodiment of the present invention.

The illustrated embodiment comprises a cylinder 2 inside which travels a displacer piston 3 and a power piston 4 driven by a reversible motor means 5 through a flywheel 7, right angle gear reducer means 8 and rhombic drive means 6. Attached to the cylinder 2 are two ports, middle port **9*a* and end port 9*b*, to which are connected heat exchanger means 10, 11. One of the heat exchanger means 11 is preferably mounted on an exterior wall 21 of the enclosure to be heated or cooled. The two heat exchanger means 10, 11 in turn are connected together by means of a regeneration chamber 12. Attached in conjunction with the heat exchanger means 10, 11 are air circulation means, not shown, which allow passage of air over the heat exchanger means 10, 11 for the transfer of thermal energy between the heat exchanger means 10, 11 and ambient air. Further attached to the cylinder 2 is a buffer cylinder 18 mounted behind the power piston 4 and in communication therewith to relieve the vacuum and compression of air behind the power piston 4. This is necessary to ensure smooth operation of the compressor as the area in the cylinder 2 connected to the buffer cylinder 18 is sealed by the power piston and end 36 of the cylinder 2**.

The rhombic drive system 6 changes rotary motion provided by the motor means 5 through the flywheel 7 and right angle speed reducer means 8 into linear motion for the movement of the power piston 4 and the displacer piston 3 in the cylinder 2.

The rotary motion is converted to linear motion as follows. The upper gear 15 of the rhombic drive means 6 is driven by the speed reducer means 8. In turn, the lower gear 14, having an axis parallel to upper gear 15, is driven by the upper gear. Each of the gears 14 and 15 has a peg 14*a* and 15*a*, respectively, protruding from the side thereof parallel to the axis from the respective gear. Each such peg is positioned near the outer edge of the respective gear, and positioned with respect to each other so that they are always vertically aligned. Two links, a forward upper link 16*a* and a rearward upper link 16*b* are pivotally attached to peg 15*a*. Similarly, two links, a forward lower link 16*c* and a rearward lower link 16*d* are pivotally attached to peg 14*a*. The distal ends of the forward upper link 16*a* and the forward lower link 16*c* are both pivotally connected to a forward clamp block 17*a*. Similarly, the rearward upper link 16*b* and the rearward lower link 16*d* are commonly connected at their distal ends to rearward clamp block 17*b*. Forward clamp 17*a* is affixed to a power piston connecting rod 19, in turn connected to the power piston 4. The rearward clamp block 17*b* is affixed to a displacer piston connecting rod 20. Displacer piston connecting rod 20 is smaller in diameter than power piston connecting rod 19. Power rod 19 is hollow, and displacer rod 20 runs slidably through rod 19 axially, and connects to displacer piston 3.

Figure 4:
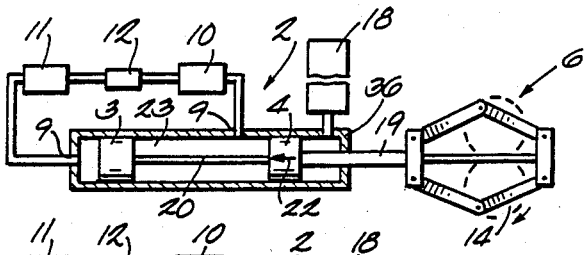
FIG. 4 is a side view partially in section of the compressor cylinder during the compression cycle in the Heating Mode.

Referring to FIGS. 4–7, the apparatus provides heating by the following method:

As shown in FIG. 4, the motor means 5 is set in motion in such a direction as to cause the lower gear 14 of the rhombic drive means 6 to rotate in the clockwise direction. This causes the power piston 4 to move toward the displacer piston 3 in the direction indicated by arrow 22 reducing the volume and thus compressing the gas between the power piston 4 and the displacer piston 3 in the area of the cylinder 2 indicated by space 23. The ambient temperature of the gas found in the space 23 of cylinder 2 is raised by the work done by the power piston 4 compressing the gas in space 23 of cylinder 2.

Figure 5:
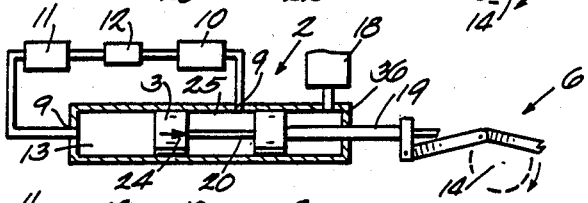
FIG. 5 is a side view partially in section of the compressor cylinder during the heat transfer cycle in the Heating Mode.

Referring to FIG. 5, the continual clockwise rotation of the lower gear 14 of the rhombic drive means 6 results in the displacer piston 3 moving toward the power piston 4 in the direction indicated by arrow 24. This results in the heated gas found in the space 25 in the cylinder 2 being sent through the middle port 9*a*, through the heat exchanger means 10 and into the regeneration chamber 12. Due to the high thermal conductivity of the material in the regeneration chamber 12 and nature's attempt to maintain a state of equilibrium, the internal temperature of the regeneration chamber 12 is raised. In the same manner, the heated gas flowing through the heat exchanger means 10 results in the transfer of thermal energy from the heat exchanger means 10 to the ambient air surrounding the heat exchanger means 10. Cool gas in heat exchanger means 11 is drawn into the space 13 behind the displacer piston 3.

Figure 6:
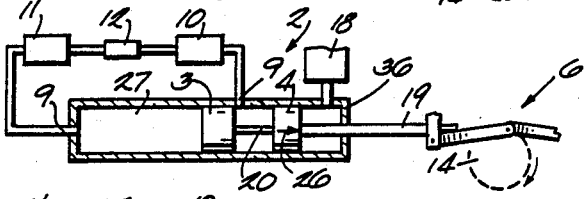
FIG. 6 is a side view partially in section of the compressor cylinder during the decompression cycle in the Heating Mode.

Referring to FIG. 6, the continued clockwise rotation of the lower gear 14 of the rhombic drive means 6 results in the power piston 4 moving away from the displacer piston 3 in the direction indicated by arrow 26. This results in the decompression of the gas found in space 27 of cylinder 2. The decompression of the gas results in a loss of thermal energy and subsequent cooling of the gas in space 27 of cylinder 2.

Figure 7:
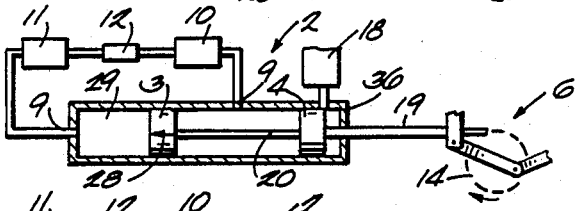
FIG. 7 is a side view partially in section of the compressor cylinder during the displacement cycle in the Heating Mode.

Referring to FIG. 7, the completion of the continued clockwise rotational cycle of the lower gear 14 of the rhombic drive means 6 results in displacer piston 3 moving away from the power piston 4 in the direction indicated by arrow 28. This results in cool gas found in space 29 of the cylinder 2 being sent through the end port 9*b*, through heat exchanger means 11 and into the regeneration chamber 12. Thermal energy is transferred from the ambient air around the heat exchanger means 11 to the cool gas being drawn into the heat exchanger means 11 to maintain a state of thermal equilibrium in the heat exchanger means 11. The gas that had previously been in the regeneration chamber 12 is sent into heat exchanger means 10. The gas drawn from heat exchanger means 11 into the regeneration chamber 12 is raised in temperature by the transfer of thermal energy from regeneration chamber 12 to maintain a state of thermal equilibrium in the regeneration chamber 12. The completion of the clockwise rotational cycle of the lower gear 14 of the rhombic drive means 6 results in the transfer of thermal energy from the ambient air surrounding heat exchanger means 11 to the ambient air surrounding heat exchanger means 10.

Figure 8:
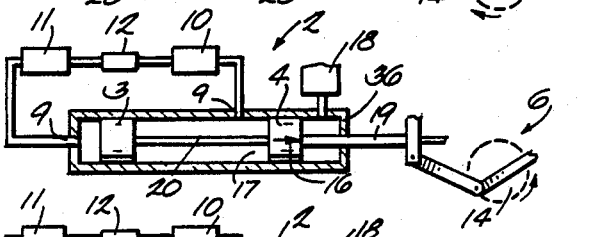
FIG. 8 is a side view partially in section of the compressor cylinder during the decompression cycle in the Cooling Mode.

Referring to FIGS. 8–11, the apparatus provides cooling by the following method:

As shown in FIG. 8, the motor means 5 is set in motion in such a direction as to cause the lower gear 14 of the rhombic drive means 6 to rotate in the counterclockwise direction. This causes the power piston 4 to move away from the displacer piston 3 in the direction indicated by arrow 16. This results in the decompression of the gas found in space 17 of cylinder 2. The decompression of the gas in space 17 of cylinder 2 results in the loss of thermal energy and subsequent cooling of the gas in space 17 of cylinder 2.

Figure 9:
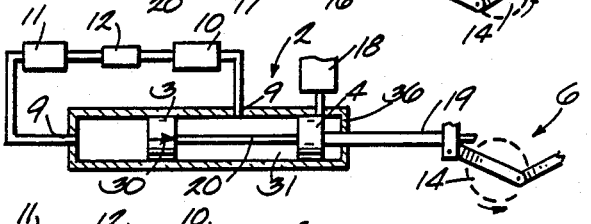
FIG. 9 is a side view partially in section of the compressor cylinder during the displacement cycle in the Cooling Mode.

Referring to FIG. 9, the continued counterclockwise rotation of the lower gear 14 of the rhombic drive means 6 results in the displacer piston 3 moving toward the power piston 4 in the direction indicated by arrow 30. This moves the cool gas found in space 31 of cylinder 2 through port 9, through heat exchanger means 10 and into the regeneration chamber 12. The ambient air around heat exchanger means 10 is reduced in temperature in an attempt to achieve a state of thermal equilibrium between the cool gas in heat exchanger means 10 and the ambient air around it. The ambient temperature of the regeneration chamber 12 is also reduced in like manner.

Figure 10:
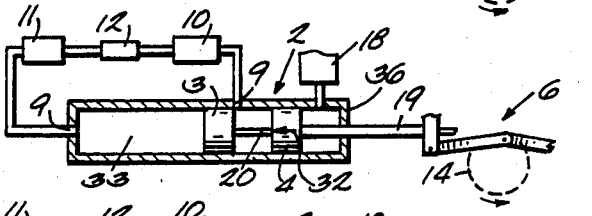
FIG. 10 is a side view partially in section of the compressor cylinder during the compression cycle in the Cooling Mode.

Referring to FIG. 10, the continued counter-clockwise rotation of the lower gear 14 of the rhombic drive means 6 results in the power piston 4 moving toward the displacer piston 3 in the direction indicated by arrow 32. This results in the compression of the gas in space 33 of cylinder 2. The ambient temperature of the gas in space 33 of cylinder 2 is raised by the work done by the power piston 4 compressing the gas in space 33 of cylinder 2.

Figure 11:
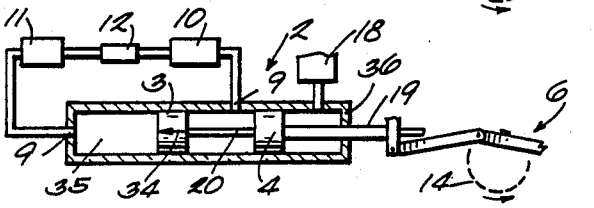
FIG. 11 is a side view partially in section of the compressor cylinder during the heat transfer cycle in the Cooling Mode.

Referring to FIG. 11, the completion of the continued counter-clockwise rotational cycle of the lower gear 14 of the rhombic drive means 6 results in the displacer piston 3 moving away from the power piston 4 in the direction indicated by arrow 34. This moves the heated gas in space 35 of cylinder 2 through port 9, through heat exchanger means 11 and into regeneration chamber 12. Thermal energy of the gas in heat exchanger means 11 is lost to the ambient air surrounding heat exchanger means 11 in an attempt to achieve thermal equilibrium between the gas in the heat exchanger means 11 and the ambient air around heat exchanger means 11. Thermal energy of the gas in the regeneration chamber 12 is reduced in an attempt to achieve thermal equilibrium between the thermally conductive material in the regeneration chamber 12 and the heated gas. The completion of the counterclockwise cycle of the lower gear of the rhombic drive means 6 results in the transfer of thermal energy from the ambient air surrounding heat exchanger means 10 to the ambient air surrounding heat exchanger means 11.

Figure 12:
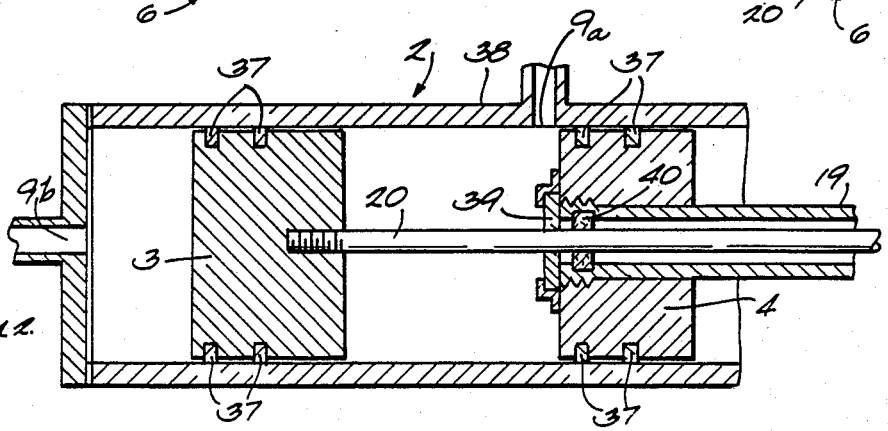
FIG. 12 is a cross-sectional view of the cylinder showing the relationship of the pistons with their respective connecting rods and subsequent sealing means.

In order to ensure that the cylinder 2 operates properly during the compression and decompression of the gas in the system, means must be provided to seal the system against leaks. Referring to FIG. 12, sealing means 37 is provided on the displacer piston 3 and the power piston 4 to prevent the loss of pressure between the pistons 3, 4 and the cylinder wall 38. These may consist of rings placed in circumferential grooves in the pistons 3, 4 that are in direct contact with the cylinder wall 38. Sealing means 39 is provided at the junction of power piston 4 and the displacer piston connecting rod 20 to prevent the loss of pressure at the junction where the displacer piston connecting rod 20 traverses through the power piston 4. Further sealing means 40 is provided at the junction of the displacer piston connecting rod 20 and the hollow power piston connecting rod 19 to prevent the loss of pressure at the junction where the displacer piston connecting rod 20 travels through the power piston connecting rod 19.

Thus, it is apparent that there has been provided, in accordance with the invention, a reversible mode heating and cooling system for the heating and cooling of an interior space that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. Apparatus operable in alternative modes to heat or cool the ambient air in a nominally interior space, comprising:

a power piston and a displacer piston arranged coaxially in said cylinder for moving toward and away from each other between said ends, a drive mechanism and means including reversible motor means for actuating said drive mechanism, said motor means being operated in different rotational directions for the heating and cooling modes, said displacer and power pistons being coupled to said drive mechanism for being moved axially in said cylinder in a cyclical predetermined relationship with each other, a first heat exchanger over which air in said interior space flows for transferring heat to said air in said interior space when the apparatus is operating in the heating mode and to absorb heat from said air when said apparatus is operating in the cooling mode, said first heat exchanger having a port in gas flow communication with a space between said pistons, a second heat exchanger over which air in a nominally exterior space flows to absorb heat from said air when said apparatus is operating in the heating mode and to transfer heat to said exterior air when said apparatus is operating in the cooling mode, said second heat exchanger having a port in gas flow communication with a space between one end of said cylinder and said displacer piston, and means including a regenerative device for coupling said heat exchangers in series so as to provide a closed gas flow path between said space between said cylinder end and displacer piston and said space between pistons.

2. Apparatus operable in alternative modes to heat or cool the ambient air in a nominally interior space, comprising:

a power piston and a displacer piston arranged coaxially in said cylinder for moving toward and away from each other between said ends, a drive mechanism and means including reversible motor means for actuating said drive mechanism, said motor means being operated in different rotational directions for the heating and cooling modes, said displacer and power pistons being coupled to said drive mechanism for being moved axially in said cylinder in a cyclical predetermined relationship with each other, a first heat exchanger over which air in said interior space flows for transferring heat to said air in said interior space when the apparatus is operating in the heating mode and to absorb heat from said air when said apparatus is operating in the cooling mode, said first heat exchanger having a port in gas flow communication with a space between said pistons, a second heat exchanger over which air in a nominally exterior space flows to absorb heat from said air when said apparatus is operating in the heating mode and to transfer heat to said exterior air when said apparatus is operating in the cooling mode, said second heat exchanger having a port in gas flow communication with a space between one end of said cylinder and said displacer piston, and means including a regenerative device for coupling said heat exchangers in series so as to provide a closed gas flow path between said space between said cylinder end and displacer piston and said space between pistons, and wherein said motor means operating in a direction to function in the heating mode resulting in a cycle wherein gas is compressed and heated in said space between said pistons such that the hot gas forced through said first heat exchanger yields heat to said interior ambient air and continues through said regenerator and through said second heat exchanger where said gas absorbs heat from said exterior ambient air and becomes decompressed and cooled in the space between said cylinder end and said displacer piston in readiness for being forced back through said closed gas flow path into said space between said pistons to start a repetition of the cycle, and wherein said motor means operating reversely to function in the cooling mode resulting in a cycle wherein said gas is compressed and heated in the space between one end of the cylinder and said displacer piston for being forced through said second heat exchanger for the gas to yield heat to said exterior ambient air and through said regenerator and said first heat exchanger to absorb heat from said interior ambient air as a result of said gas being decompressed and cooled as it is drawn through said second exchanger and into the increasing space between said pistons in readiness for being forced back through said closed flow path into said space between said cylinder end and the displacer piston to start a repetition of the cycle.

3. The apparatus according to any one of claims 1 or 2 wherein said drive mechanism is a rhombic drive mechanism comprising:

intermeshed gears at least one of which is driven by said motor means in a selected one of two possible directions of rotation so the other gear rotates in the opposite direction, two pairs of links, each pair composed of two links having pivot connections to each other, the pivot connection of one pair also pivotally connecting to one gear at one angular position and the pivot connection of the other pair also pivotally connecting to the other gear at a corresponding angular position, first and second connector means, corresponding links in each pair being pivotally connected, respectively, to the first connector means and other corresponding links in each pair pivotally connected, respectively, to the second connector means for converting the rotational motion of the gears to linear motion of the first and second connector means, the first connector means being more remote from said cylinder than said second connector means, first rod means connected to said first connector means and extending axially into said cylinder for connecting to said displacer piston, a tubular rod means connector to said second connector means and extending axially into said cylinder for connecting to said power piston, said first rod means extending axially through said tubular rod means and through said power piston.

4. The apparatus according to any one of claims 1 or 2 wherein said regenerative device comprises a hollow chamber having a heat storage and exchanging medium therein through which said gas passes.

5. The apparatus according to any one of claim 1 or 2 wherein said heat exchanger means comprises a metal tube and a plurality of generally parallel substantially planar metal plates disposed along and attached to the exterior of said tube, the tube is generally perpendicular to the plates and passes through the plates.

6. The apparatus according to any one of claims 1 or 2 including a buffer cylinder in communication with the space in said cylinder between said power piston and one of said ends of the cylinder to provide for minimizing the development of back pressure when said power piston moves toward said end of the cylinder and development of negative pressure when said power piston moves away from said end.

7. The apparatus according to claim 4 wherein said heat storage and exchanging medium is a high heat storage material such as metal fillings.

8. The apparatus according to claim 7 wherein said fillings are composed of copper.

9. A method of transferring heat to the ambient air in a nominally interior space to be heated comprising the steps in a cycle of:

compressing a gas in the space between a first piston and a second piston arranged between the two ends of a cylinder by moving at least one piston toward the other to cause the temperature of the gas to increase, moving the second piston further away from one end of said cylinder to force the heated gas through the gas conduction passageway of a first heat exchanger in the space to be heated for said gas to give heat to said ambient air, conducting said gas from said first heat exchanger into and through a regenerative heat storage device to extract more heat from said gas and then continuing to conduct said gas through the gas conduction passageway of a second heat exchanger which is connecting to a space between said one of the cylinder and said second piston such that said movement of said second piston away from said one end causes decompression of said gas in said cylinder and in said second heat exchanger such that said gas is cooled to below the temperature of the ambient air around said second heat exchanger for absorbing heat from said last named ambient air, then moving said pistons through a sequence wherein said second piston forces said gas with heat absorbed therein reversely through said second heat exchanger and said regenerative device to absorb heat stored therein and then back to the space in said cylinder for being compressed again to start another cycle.

10. A method of extracting heat from the ambient air of a nominally interior space to be cooled comprising the steps in a cycle of:

providing a cylinder in which there are first and second pistons arranged between the two ends of the cylinder, disposing a first heat exchanger in the ambient air of said space to be cooled and disposing a second heat exchanger in ambient air apart from said first heat exchanger and having a regenerative heat storage device connecting the gas passageways of said exchangers and device in series and having said first heat exchanger in communication with the space in said cylinder between said pistons and the second heat exchanger in communication with the space between said second piston and one end of said cylinder to form a closed gas conduction path from one of said spaces in said cylinder to the other.

moving said pistons such that a space develops between them into which gas is drawn through said first heat exchanger and decompressed or expanded in the cylinder such that said gas in said first exchanger is also decompressed which results in cooling said gas so the gas in said first heat exchanger absorbs heat from the ambient air in the space to be cooled, continuing to move said pistons such that at least said second piston forces said cool gas from said cylinder through said first heat exchanger and through said regenerative device in which heat is absorbed by said gas while at the same time said second piston is moving away from said one end of the cylinder so as to draw the gas out of said second heat exchanger into said cylinder, reversing the direction of movement of said second piston to cause said gas to be compressed so its temperature rises and is caused to flow reversely through said second heat exchanger wherein said gas gives up heat to the ambient air surrounding said second heat exchanger and through said regenerative device wherein said gas gives up more heat and through said first heat exchanger and into said space between said pistons to be decompressed and cooled again to start another cycle.

* * * * *